US008934653B2

(12) United States Patent
Pelonis

(10) Patent No.: US 8,934,653 B2
(45) Date of Patent: Jan. 13, 2015

(54) RHOMBOID SHAPED ACOUSTIC SPEAKER

(76) Inventor: Chris Pelonis, Goleta, CA (US)

( * ) Notice: Subject to any disclaimer, the term of this patent is extended or adjusted under 35 U.S.C. 154(b) by 228 days.

(21) Appl. No.: 13/349,455

(22) Filed: Jan. 12, 2012

(65) Prior Publication Data

US 2012/0183167 A1 Jul. 19, 2012

Related U.S. Application Data

(60) Provisional application No. 61/432,477, filed on Jan. 13, 2011.

(51) Int. Cl.

| | |
|---|---|
| ***H04R 9/06*** | (2006.01) |
| ***H04R 5/02*** | (2006.01) |
| ***H04R 1/28*** | (2006.01) |
| *H04R 1/24* | (2006.01) |

(52) U.S. Cl.

CPC ..... *H04R 5/02* (2013.01); *H04R 1/2803* (2013.01); *H04R 1/24* (2013.01); *H04R 2201/028* (2013.01)

USPC ..... 381/336; 381/98; 381/335

(58) Field of Classification Search

CPC ..... H04R 1/02; H04R 1/26; H04R 1/025; H04R 1/323; H04R 1/2888

USPC ..... 381/98, 335, 336

See application file for complete search history.

(56) References Cited

U.S. PATENT DOCUMENTS

| | | | | |
|---|---|---|---|---|
| 4,168,762 | A | 9/1979 | Griffin, Jr. | |
| 4,231,446 | A * | 11/1980 | Weiss et al. | 181/148 |
| 4,237,341 | A | 12/1980 | Richards | |
| 4,381,831 | A | 5/1983 | Putnam | |
| 4,410,064 | A * | 10/1983 | Taddeo | 181/152 |
| 4,440,259 | A | 4/1984 | Strohbeen | |
| 4,673,057 | A * | 6/1987 | Glassco | 181/144 |
| 6,807,284 | B2 | 10/2004 | Nakamura | |
| 7,274,797 | B2 | 9/2007 | Hungerford | |
| 7,570,778 | B2 | 8/2009 | Wright | |
| 7,826,633 | B2 | 11/2010 | Davi | |
| 7,970,149 | B2 | 6/2011 | Reardon et al. | |
| 7,997,381 | B2 | 8/2011 | Gordon | |
| 2005/0053253 | A1 | 3/2005 | Sterns | |
| 2005/0084126 | A1 | 4/2005 | Milton | |
| 2005/0135647 | A1 | 6/2005 | Lin | |
| 2007/0076912 | A1 | 4/2007 | Griffiths | |
| 2007/0127738 | A1 * | 6/2007 | Yamada et al. | 381/98 |
| 2009/0214067 | A1 | 8/2009 | Bothe | |
| 2009/0252354 | A1 | 10/2009 | Dunn | |
| 2009/0279732 | A1 | 11/2009 | Maurer et al. | |
| 2009/0316947 | A1 | 12/2009 | Liu | |

* cited by examiner

*Primary Examiner* — Alexander Jamal

(74) *Attorney, Agent, or Firm* — Schmeiser, Olsen & Watts LLP

(57) ABSTRACT

The present invention relates to a speaker housing having a rhomboid geometric shape. The rhomboid shape is a polyhedron with six faces, each of which is a parallelogram. The opposite sides of each parallelogram are substantially equal in length and their adjacent angles are substantially supplementary. The rhomboid shape of the speaker housing allows the listener to position the speakers in order to optimize the trajectory of the driver in a variety of listening situations, providing an accurate and optimized response for the listener. The rhomboid shape of the speaker housing and the utilization of point source, coaxial, dual concentric, triaxial, triconcentric or other multi-concentric driver configurations and/or single driver loudspeaker driver technologies in the speaker can create a unique performance and functionality to this design.

23 Claims, 4 Drawing Sheets

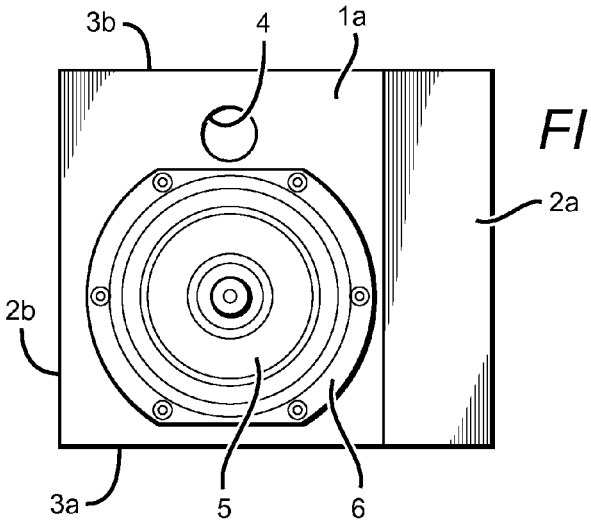
FIG. 3B
FIG. 3C
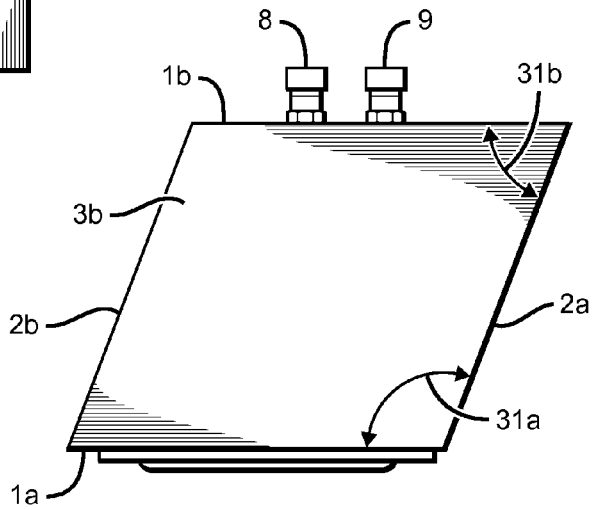
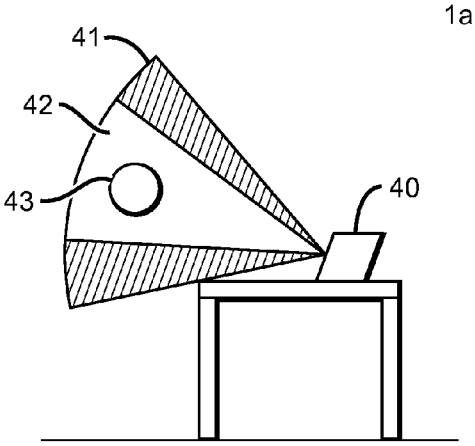
FIG. 4A
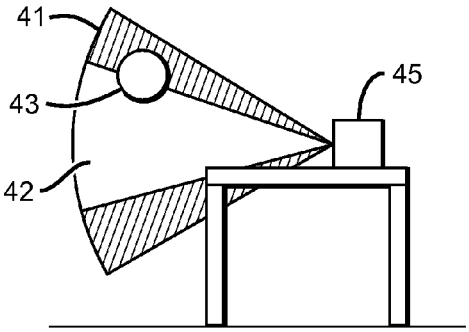
FIG. 4B

FIG. 5A
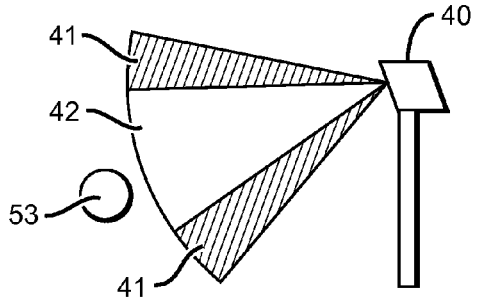
FIG. 5B
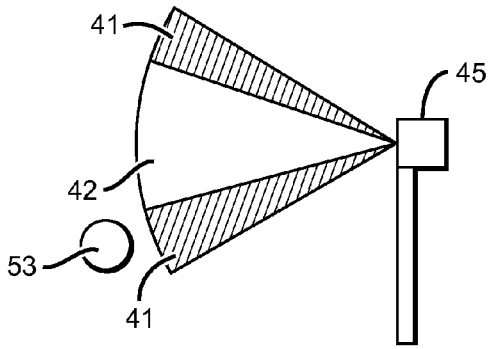
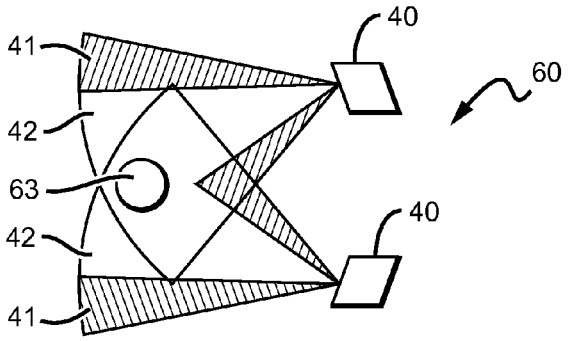
FIG. 6A
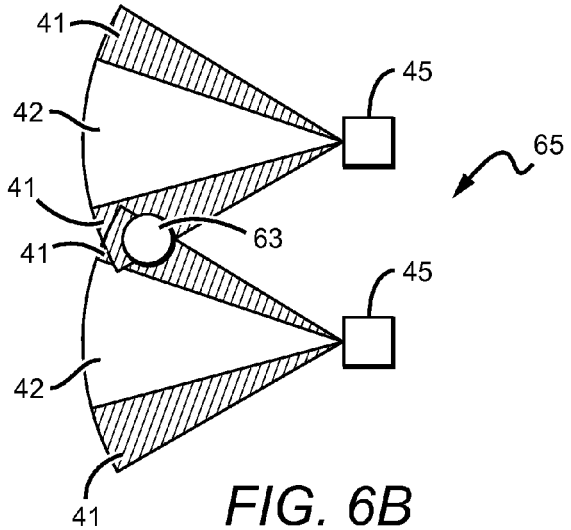
FIG. 6B

RHOMBOID SHAPED ACOUSTIC SPEAKER

CROSS-REFERENCE TO RELATED APPLICATIONS

This application claims priority to U.S. Provisional Patent Application to Pelonis, entitled "Rhomboid Shaped Acoustic Speaker," Ser. No. 61/432,477, filed Jan. 13, 2011, the disclosure of which is hereby incorporated entirely herein by reference.

BACKGROUND

1. Technical Field

This invention relates generally to acoustical reproducing apparatus and, more particularly, to the improved performance of rhomboid shaped speakers.

2. State of the Art

A loudspeaker (or "speaker") is an electroacoustic transducer that produces sound in response to an electrical audio signal input. The most common form of loudspeaker uses a paper cone supporting a voice coil electromagnet acting on a permanent magnet, but many other types exist. Where accurate reproduction of sound is required, multiple loudspeakers may be used, each reproducing a part of the audible frequency range. Miniature loudspeakers are found in devices such as radio and TV receivers, as well as many forms of music players. Larger loudspeaker systems are used for music, sound reinforcement in theatres and concerts, and in public address systems.

The term "loudspeaker" or "speaker" may refer to individual transducers (known as "drivers") or to complete speaker systems consisting of an enclosure including one or more drivers. To adequately reproduce a wide range of frequencies, most loudspeaker systems employ more than one driver, particularly for higher sound pressure level or maximum accuracy. Individual drivers are used to reproduce different frequency ranges. The drivers are named subwoofers (for very low frequencies); woofers (low frequencies); mid-range speakers (middle frequencies); tweeters (high frequencies); and sometimes supertweeters, optimized for the highest audible frequencies. The terms for different speaker drivers differ, depending on the application. In two-way systems there is no mid-range driver, so the task of reproducing the mid-range sounds falls upon the woofer and tweeter. Home stereos use the designation "tweeter" for the high frequency driver, while professional concert systems may designate them as "HF" or "highs". When multiple drivers are used in a system, a "filter network", called a crossover, separates the incoming signal into different frequency ranges and routes them to the appropriate driver. A loudspeaker system with n separate frequency bands is described as "n-way speakers": a two-way system will typically have a woofer and a tweeter; a three-way system usually employs a woofer, a mid-range, and a tweeter.

An audio acoustical reproduction apparatus or system typically includes a rectangular housing having at least one speaker and amplifier. The speaker or speaker system converts audio waves into corresponding sound waves. Ideally, a speaker or speaker system should optimize the conversion of audio voltage to density waves of audio frequency and amplitude in a manner that minimizes distortion. The preservation of the fidelity of an audio signal from the pickup to the output in such an apparatus or system is of the utmost importance with respect to the quality of sound generated. In order to achieve maximum fidelity, a number of strategies of been employed including optimization of one or more electromechanical components of the speaker device itself, modifications in the design of the driver or speaker cone; and improvements in the speaker diaphragm, the speaker housing or the resident cavity to which the drivers are coupled. However, both prior and contemporary designs in speakers and speaker systems have not provided the desired audio frequency response.

Acoustical distortion occurs in many ways. One major problem with the frequency response of traditional speakers and speaker systems, for example, results from the high and low frequency drivers being located at different positions within a speaker housing. The frequency response is dependent upon the position of the listener/receiver in relationship to the speaker and, in particular, to these two drivers. The corresponding variation in the time arrival of the entire frequency spectrum, as produced by a combination of high and low frequency drivers that are not concentric, results in degradation of the over frequency response and phase response of the speaker as a function of the placement of the speaker in relation to a listener/receiver.

The trajectory for optimal frequency and phase response emitted by a speaker is also dependent upon the position of the listener/receiver in relation to the speaker or speaker system. As a result, a speaker or speaker housing usually has to be mounted or otherwise positioned at a particular angle with respect to a listener/receiver in order to provide that optimal response trajectory. A typical rectangular housing may, for example, be angled upwards or downwards when a listener (including without limitation a person or animal) or receiver (including without limitation a recording or transmitting device) is located above or below the speaker, respectively. Alternatively, a speaker or housing may be positioned on a surface or suspended at ear level when the trajectory for optimum response requires an inward (e.g. substantially level) directivity. Furthermore, any subsequent change in listener or receiver position, including without limitation when a listener moves from one location in a room to another or from an upright to a supine position, requires a corresponding change in the position of the speaker/housing. Adapting to such changes are often problematic, including without limitation the corresponding adjustments in speaker angle required at an outdoor music venue where a speaker/housing may be mounted high above ground level, and/or the speaker/housing is very large or otherwise difficult to move.

Information relevant to attempts to alleviate such problems by modifying the geometry of the speaker housing or placement/shape of the drivers or other speaker components can be found in the following references: U.S. Pat. Nos. 4,168,762; 4,237,341; 4,440,259; 6,807,284; 7,274,797; 7,570,778; 7,826,633; 7,970,149; 7,997,381; U.S. Patent Appl. No. 2005/0053253; U.S. Patent Appl. No. 2005/0084126; U.S. Patent Appl. No. 2005/0135647; U.S. Patent Appl. No. 2007/0076912; U.S. Patent Appl. No. 2009/0214067; U.S. Patent Appl. No. 2009/0252354; U.S. Patent Appl. No. 2009/0279732; and U.S. Patent Appl. No. 2009/0316947. However, each of these references suffers from one or more of the following disadvantages:

1. The high and low frequency drivers are not concentric, resulting in degradation of the over frequency response and phase response of the speaker as a function of the placement of the speaker in relation to a listener or receiver; and 2. Accurate measurement and labor/time intensive repositioning of a speaker or speaker housing relative to a listener or receiver is required in order to provide that listener or receiver with an adequate or optimal frequency and phase response.

Thus there remains a need within the music industry for speakers and other acoustical apparatus that mitigates or removes the acoustical distortion resulting from driver placement, and which can provide an optimal response to a listener/receiver without requiring accurate measurement or labor/time intensive repositioning.

BRIEF DESCRIPTION OF THE DRAWINGS

Further objects, features and advantages of the invention will become apparent from the detailed description, below, when read in conjunction with the accompanying drawings in which:

FIG. 3B illustrates a front view of the speaker embodiment illustrated in FIG. 3A.

FIG. 3C illustrates a top view of the speaker embodiment illustrated in FIG. 3A.

FIG. 4A illustrates the dispersion characteristics of the high frequency driver of one embodiment of a rhomboid speaker positioned on a desk top in relation to one typical, exemplary location of a listener's head when the required location of the speaker is positioned below the listener's head.

FIG. 4B illustrates the dispersion characteristics of the high frequency driver of a rectangular speaker positioned at the same location as the rhomboid speaker, and in relation to with the same location of the listener's head, as illustrated in FIG. 4A.

FIG. 5A illustrates the dispersion characteristics of the high frequency driver of one embodiment of a rhomboid speaker in relation to the location of a listener's head when the required location of the speaker is elevated above the listener's head, including but not limited to the situation of viewing a video or television display/screen.

FIG. 5B illustrates the dispersion characteristics of the high frequency driver of a rectangular speaker at the same location as the rhomboid speaker, and in relation to the same location of the listener's head, as illustrated in FIG. 5A.

FIG. 6A illustrates the dispersion characteristics of the high frequency drivers of one embodiment of a rhomboid speaker system at ear level, where the system has one speaker angled downwards, a second speaker angled upwards, and the listener's head is equidistant from both the first and second speakers.

FIG. 6B illustrates the dispersion characteristics of the high frequency drivers of a rectangular speaker system having two rectangular speakers at the same location as the rhomboid speakers, and in relation to the same location of the listener's head, as illustrated in FIG. 6A.

DETAILED DESCRIPTION

Figure 1A:
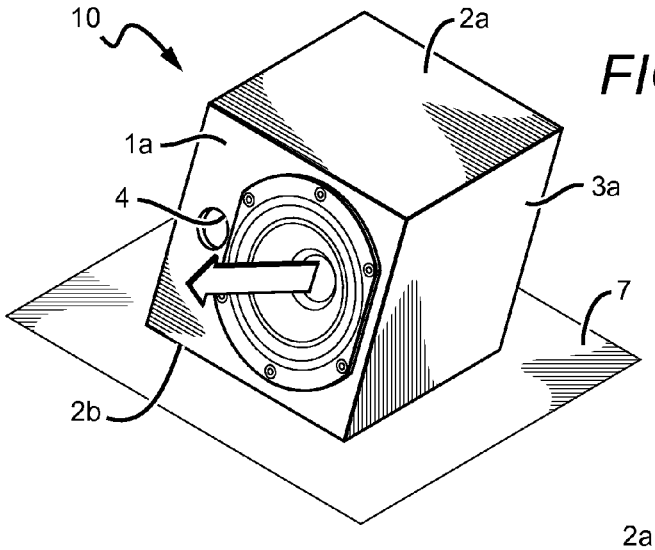
FIG. 1A illustrates a perspective view of one embodiment of the rhomboid speaker when positioned on a surface where the trajectory for optimum response requires upward directivity including without limitation a desktop.

The following description is of a best mode presently contemplated for practicing the invention. This description is not to be taken in a limiting sense but is made merely for the purpose of describing the general principles of the invention whose scope may be ascertained by referring to the appended claims.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

Also, use of the "a" or "an" are employed to describe elements and components of the invention. This is done merely for convenience and to give a general sense of the invention. This description should be read to include one or at least one and the singular also includes the plural unless it is obvious that it is meant otherwise.

Unless otherwise defined, all technical and scientific terms used herein have the same meaning as commonly understood by one of ordinary skill in the art to which this invention belongs. Although a few suitable, exemplary processes and materials are described below, other processes and materials similar or equivalent to those described herein can also be used in the practice or testing of the invention. All publications, patent applications, patents, and other references mentioned herein are incorporated by reference in their entirety. In case of conflict, the present specification, including definitions, will control. In addition, the materials, processes, and examples are illustrative only and not intended to be limiting.

The following definitions refer to the particular embodiments described herein and are not to be taken as limiting; the invention includes equivalents for other undescribed embodiments.

As used herein, the term "concentric" is intended to mean of or denoting circles, arcs, or other shapes that share or substantially share the same center, axis or origin, with one inside the other and the larger often completely surrounding the smaller.

As used herein, the term "parallelepiped" is intended to mean a structure having six faces in which each face is a parallelogram and pairs of opposite faces lie in parallel planes. Equivalents: a polyhedron with six faces each of which is a parallelogram; a hexahedron with three pairs of parallel faces; and a prism of which the base is a parallelogram.

As used herein, the term "rhomboid" is intended to mean a parallelepiped. Equivalent terms; rhombohedron, parallelepiped.

The invention disclosed herein relates generally to speakers and, more particularly, to the improved performance of rhomboid shaped speakers. The rhomboid shape of the speaker housing and the utilization of suitable drivers, in the speaker, including without limitation point source, coaxial, triaxial, dual concentric, tri-concentric or other multi-concentric driver configurations (containing 4 or more drivers or driver technologies) and/or single driver loudspeaker driver technologies, create a unique performance and functionality to this design. All speakers have a region where the on axis to off axis response provides the highest possible quality results with regard to phase and frequency response. Beyond that region, typically, the high frequency gradually diminishes in amplitude and accuracy. A rhomboid shaped speaker housing allows the listener to accurately and easily position the speakers in order to optimize the trajectory of the driver in a variety of listening situations, thereby providing an optimal response for the listener. The rhomboid shaped housing is a polyhedron with six faces or panels, each of which is a parallelogram. In each panel, the opposite sides of each parallelogram are equal in length, the opposite angles are equal, the adjacent sides are of unequal lengths, the adjacent angles are oblique and supplementary (add up to 180 degrees,) and one of the adjacent angles is larger than the other. Because of the nature of these angles and the resulting rhomboid shape, the output and/or trajectory of the speaker can be easily and accurately redirected, including without limitation upwards, inwards, or downwards, simply by changing the side of the housing used for support.

In one embodiment, a high frequency driver is positioned in the center of a larger, low frequency driver including without limitation coaxial, point source or dual concentric drivers. As a result, the distance from the center of the source of both the high frequencies and low frequencies generated, to the listener/receiver, is consistent regardless of the position of the listener or receiver in relation to the speaker. This results in a consistent time arrival for the entire frequency spectrum produced by the combination of the high frequency driver and the low frequency driver in this embodiment. By keeping the time arrival constant, the overall frequency response and phase response of the speaker will not be degraded as a result of the position of a listener/receiver to the speaker other than the natural off axis response of the driver/drivers themselves.

In another embodiment, the rhomboid speaker housing does not include an amplifier, allowing the speaker size to be relatively small while retaining the capacity to emit high volume sound when connected to an external amplifier. The length of the sides of the housing in that embodiment are therefore not dependent upon the size or shape of an amplifier, but rather on other physical dimensions including without limitation the number, size and placement of the speaker drivers and required cubic dimensions for the desired frequency response and/or aesthetic value. In yet another embodiment, the speaker housing does include at least one amplifier. In a further embodiment, all four sides of each parallelogram (panel) in the housing are equal in length.

Figure 1B:
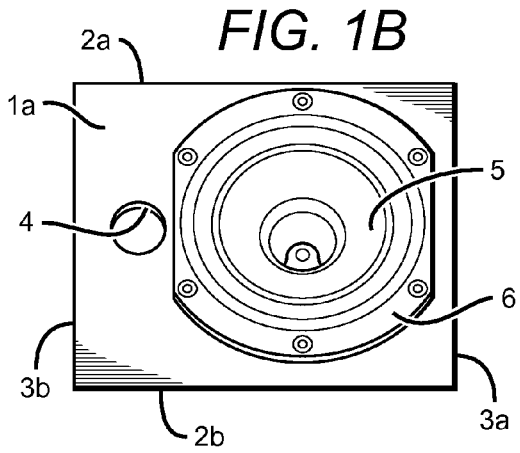
FIG. 1B illustrates a front view of the embodiment of the rhomboid speaker shown in FIG. 1A.
Figure 1C:
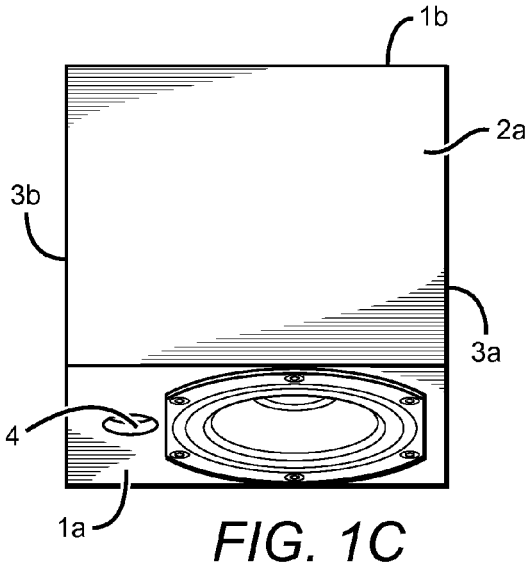
FIG. 1C illustrates a top view of the rhomboid speaker shown in FIG. 1A.
Figure 1D:
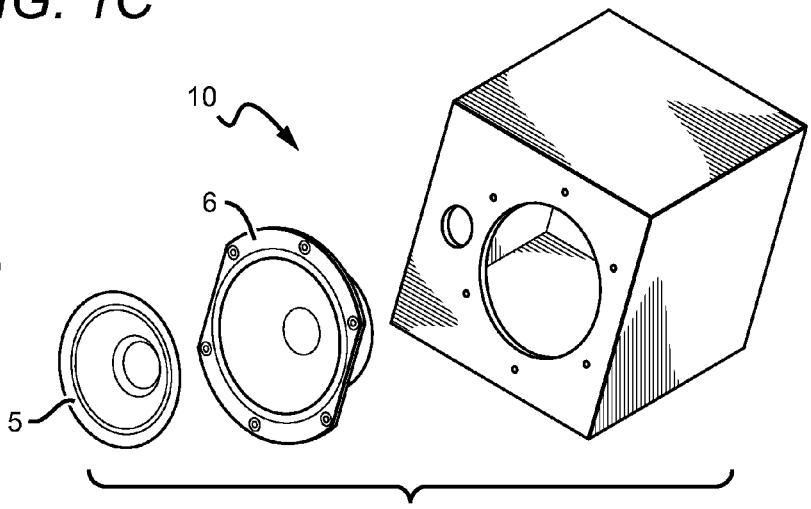
FIG. 1D illustrates an exploded view of the concentric high and low frequency drivers shown in FIG. 1A.

FIGS. 1A-C illustrate a perspective, front and top view, respectively, of one embodiment of the speaker 10 when positioned on a surface 7 where the trajectory for optimum response requires upward directivity such as a desktop, as indicated by the arrow in FIG. 1A. Panel 2*b* is positioned on the surface 7 in this embodiment. The position of the front panel 1*a* opposes that of the back panel 1*b*. The side panel 3*b* adjacent to the low frequency response tuning port opening 4 is similarly positioned opposite to panel 3*a*. The position of the top panel 2*a* of the speaker similarly opposes panel 2*b*. The smaller high frequency driver 5 is positioned in the center of the larger low frequency driver 6. The dispersion characteristics of the high frequency driver in this embodiment are illustrated, for example, in FIG. 4A. Optionally, the rhomboid speaker of this embodiment can include an internal amplifier.

Figure 2A:
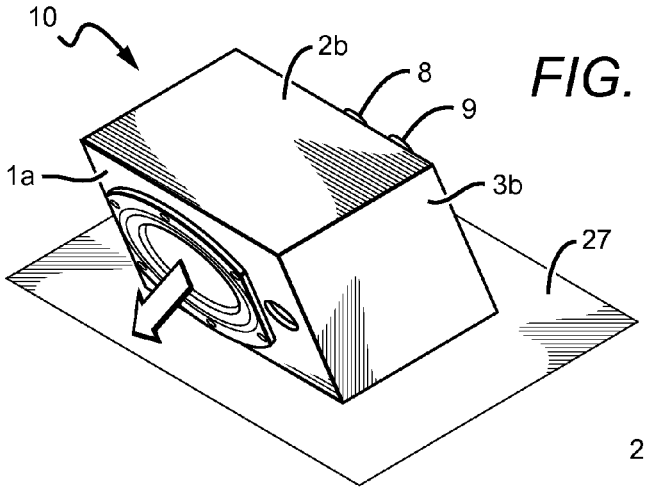
FIG. 2A illustrates a perspective view the rhomboid speaker shown in FIG. 1A when positioned on a surface where the trajectory for optimum response requires downward directivity.
Figure 2B:
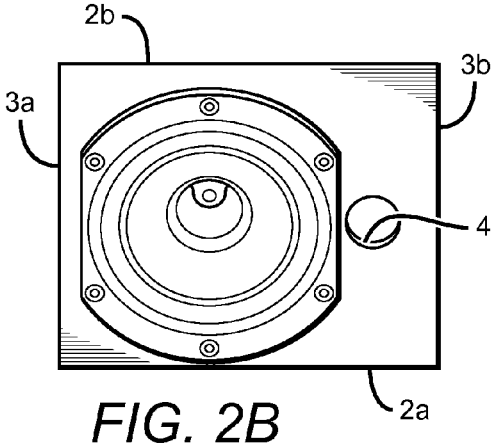
FIG. 2B illustrates a front view of the rhomboid speaker shown in FIG. 2A.
Figure 2C:
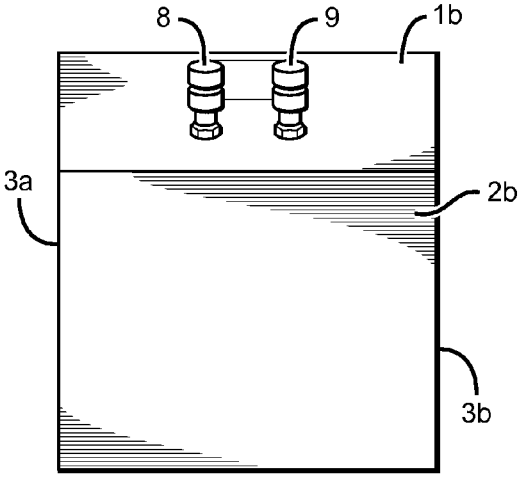
FIG. 2C illustrates a top view of the rhomboid speaker illustrated in FIG. 2A.

FIGS. 2A-C illustrate a perspective, front and top view, respectively, of the speaker embodiment 10 illustrated in FIGS. 1A-C respectively when positioned on a surface 27 where the trajectory for optimum response requires downward directivity as indicated by the arrow in FIG. 2A, including without limitation over a television, on a book shelf or on a recording console where the elevation of the console top is at a height above the listener's head. Panel 2*a* is positioned on the surface 27 in this embodiment and two amplifier connectors 8 and 9 are positioned as illustrated on the back panel 1*b* of the speaker. The dispersion characteristics of the high frequency driver of this embodiment are illustrated, for example, in FIG. 5A.

Figure 3A:
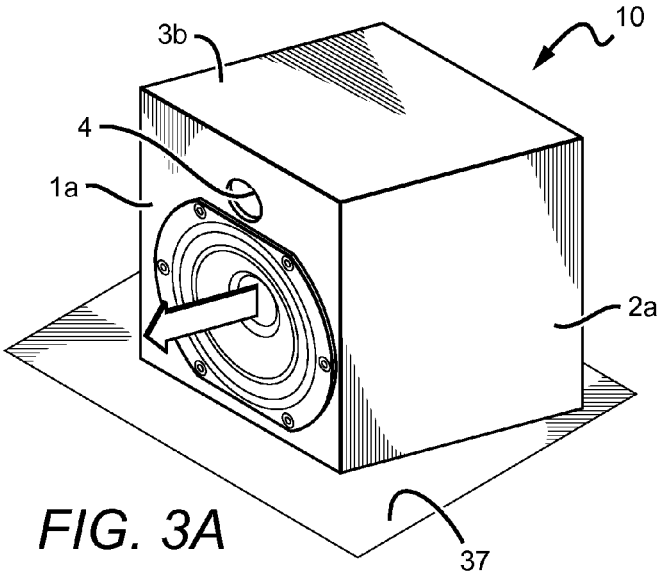
FIG. 3A illustrates a perspective view of the speaker embodiment shown in FIG. 1A when positioned on a surface or suspended at ear level where the trajectory for optimum response requires an inward directivity.

FIGS. 3A-C illustrate a perspective, front and top view, respectively, of the speaker embodiment 10 illustrated in FIGS. 1A-C respectively when positioned on a surface 37 or suspended at ear level where the trajectory for optimum response requires an inward directivity, as indicated by the arrow in FIG. 3C, in order to improve alignment to the listener and/or for aesthetic purposes. Panel 3*a* is positioned on the surface 37 in this embodiment and an exemplary 111 degree angle 31*a* with a supplementary 69 degree angle 31*b* are shown for the top panel 3*b* in FIG. 3C. Accurate alignment to the listener can be achieved with ease via the result of using the correct angle geometry as presented by the speaker housing to the front wall as opposed to the much more difficult alignment required when angling rectangular speakers to achieve similar results, including without limitation mounting or suspending a rectangular speaker at the correct angle using external means. The dispersion characteristics of the high frequency driver of this embodiment are illustrated, for example, in FIG. 6A.

In one alternate embodiment, Panel 3*b* can be similarly positioned on surface 37 to improve alignment to the listener and/or for aesthetic purposes. In contrast, a rectangular speaker would need to be accurately aimed at the listener/receiver and, if it is to be done accurately or exactly, there would need to be a protractor involved for measurement, and the new position would need to be physically marked, prior to physically repositioning the speaker.

FIG. 4A illustrates one embodiment of a rhomboid speaker 40 positioned on a desk top with one typical, exemplary location of the listener's head 43 and the dispersion characteristics of the high frequency driver in that configuration. The dispersion characteristics illustrated include the optimum listening region 42 as well as the boundary of high frequency response 41 at −6 dB. FIG. 4B illustrates, in comparison with FIG. 4A, a typical rectangular speaker 45 in the same location on the desk top and relation to the listener. The rhomboid speaker puts the listener's head 43 in the perfect position to accept the most accurate response of the high frequency. Furthermore, the outer range of the high frequency does not intersect with the desktop, which eliminates high frequency reflections from the surface. In contrast, the rectangular speaker shown in FIG. 4B does not provide the position of accurate response 42 to the listener and exhibits high frequency reflections from the desktop. These reflections cause secondary reception by the listener of the high frequency (i.e. at a different time arrival) causing inaccurate phase and frequency responses.

FIGS. 5A-B illustrate, respectively, a comparison of one embodiment of a rhomboid speaker 40 and a typical, exemplary rectangular speaker 45 in relation to the location of the listener's head 53 and the dispersion characteristics of the high frequency driver while speaker is elevated above the listener's head including but not limited to viewing a video or television display/screen which may lie adjacent to the speaker. The dispersion characteristics illustrated include the optimum listening region 42 as well as the boundary of high frequency response 41 at −6 dB. The rhomboid speaker 40 shown in FIG. 5A provides the listener with an accurate, optimized response 42 while in the correct relationship to the screen for viewing. The corresponding rectangular speaker 42 shown in FIG. 5B does not.

FIGS. 6A-B illustrate, respectively, a comparison between one embodiment of an audio system 60 having two rhomboid speakers 40 and a corresponding, typical system 65 having two rectangular speakers 45 at ear level for the listener 63. The rhomboid speakers 40 shown in FIG. 6A, when positioned using the correct angle with respect to the front wall as shown, have the correct geometry to provide the listener with an accurate and optimal response, as delivered by the high frequency trajectory of the speakers 42, when positioned equidistant from the speakers. This is the correct listening position for accurate imaging in the stereo field whether listening to stereo, 2.1, 3.1, 5.1 or 7.1 sources, for example. The accurate alignment to the listener is achieved with ease via the use of the correct angle geometry with respect to the front wall as provided by the rhomboid shaped housing, as opposed to the much more difficult alignment required when angling rectangular speakers to achieve similar results. In one embodiment, for example, the side panels 2*a* and 2*b* of the rhomboid shaped speaker can be positioned perpendicular to the front wall in order to provide the correct directivity and trajectory to the listener, as illustrated in FIG. 6A.

In FIG. 6B, the rectangular speakers 45, in the same location in relation to the listener 63 as illustrated for the rhomboid speakers shown in FIG. 6A, cause the listener to be located far outside of the optimum high frequency response region 42 and nearly beyond the region of the high frequency dispersion 41. Although the rectangular speaker could be arranged to point inwards or downwards, it would require precise measurement to achieve the exact angle required to provide an accurate and optimal response, whereas the rhomboid speaker is correctly angled with ease and accuracy when placed on the side panel which presents the correct angle geometry with respect to the front wall. Therefore, because of the substantially concentric arrangement of the drivers in the speaker, the distance from the center of the source of high frequencies and low frequencies in the speaker embodiments illustrated above is consistent regardless of the position of the listener/receiver in relationship to the speaker. This results in a consistent time arrival of the entire frequency spectrum produced by the combination of the high frequency driver and the low frequency driver. By keeping the time arrival constant, the over frequency response and phase response of the speaker will not be degraded as a result of position of listener/receiver to speaker other than the natural off axis response of the driver/drivers themselves.

In the case of a single driver where one driver delivers all frequencies, the same holds true. The natural off axis characteristics of the driver or drivers combined will be consistent regardless of polar off axis positioning of the listener/receiver to the speaker. The rhomboid speaker therefore can provide similar on and off axis responses while minimizing reflection and phase changes.

Furthermore, a rhomboid shaped speaker can be fabricated such that it will present the correct geometry with respect to optimizing the trajectory of the driver in a variety of listening situations, thereby providing an accurate and optimized response to a listener or receiver.

In another embodiment, a loudspeaker system using one or more of rhomboid speakers can also require at least one external amplifier. In yet another embodiment, the system could include two speakers, as illustrated in FIG. 6A, and one external amplifier. The use of an amplifier external to the speaker allows the size of the rhomboid speaker enclosure to be minimized without compromising the volume or quality of sound that speaker can emit. It also decreases the number of attachment points required on the speaker unit since none would be required for an external (rather than internal) amplifier, thereby reducing the amount of time, materials and effort required fabricate the speaker or to assemble a loudspeaker system on site. Furthermore, the total cost of a loudspeaker system may be reduced where multiple speakers share the same amplifier.

In a further embodiment, a rhomboid speaker can include an internal amplifier. The length, width height and angles of the panels a rhomboid speaker can vary widely in order to accommodate a desired result or use. Furthermore, the size of the speaker is limited only by the fact that it must provide a practical use.

Any suitable high or low frequency driver can be used in a rhomboid shaped speaker, including without limitation one or more Tannoy drivers. The housing may be fabricated from compressed particle board, but other suitable materials include without limitation other types of wood or wood products and/or any rigid material with similar density. The sides of the housing can be attached using nails but any suitable means of attachment can be used, including without limitation adhesive.

The speaker may be attached to external amplification, including without limitation multi-amplified using external signal processing (including without limitation digital, active analog or passive analog processing) or single channel amplified using any suitable means including without limitation internal passive analog processing. In the case of external amplification and processing, amplification and processing may coexist in one enclosure or exist in separate enclosures.

EXAMPLE 1

The Model 42™ loudspeaker is a rhomboid shaped speaker containing six parallelogram-shaped panels as illustrated in FIGS. 1A-C, 2A-C and 3A-C. The adjacent sides in this structure are of unequal lengths and the angles are oblique. The pairs of opposing and equal corner angles in each parallelogram in the housing are 111.08 degrees for the larger of the two corner angles 31*a* and 68.92 degrees for the smaller angle 31*b* as shown for panel 3*b* in FIG. 3C. The Model 42™ loudspeaker can provide optimal benefit within a range of plus or minus about 5 degrees with respect to the larger of the two angles in this particular model. The high frequency compression driver 6 shown in FIG. 3B is a source compression driver but could be replaced by variety of suitable driver types that deliver high frequency. The low frequency driver 5 shown in FIG. 3B is a woofer but could be replaced with a variety of suitable driver types that delivers low frequency. See also the specification sheet for the Model 42™ on the Pelonis Sound and Acoustics website.

While several illustrative embodiments of the invention have been disclosed herein, still further variations and alternative embodiments will occur to those skilled in the art. Positioning the high frequency driver in the center of the larger low frequency driver, for example, is useful wherever the natural off axis characteristics of the driver or driver combination need to be consistent regardless of the position of the listener/receiver to the speaker including, besides those described above, and the size of the speakers can vary in order to optimize them for a particular use. Such variations and alternative embodiments are contemplated, and can be made without departing from the spirit and scope of the invention as defined in the appended claims.

While several illustrative embodiments of the invention have been disclosed herein, still further variations and alternative embodiments will occur to those skilled in the art. Therefore, the rhomboid shape of the speaker housing may deviate somewhat from a true rhomboid shape while still allowing a listener to position the speakers to optimize the trajectory of the driver in a variety of listening situations and thereby provide an accurate response for the listener. Such variations and alternative embodiments are contemplated, and can be made without departing from the spirit and scope of the invention as defined in the appended claims.

I claim:

1. An acoustical reproducing apparatus comprising: a housing comprising:

a first front panel and a second back panel, wherein the first and the second panel are opposed to each other;

at least two pairs of substantially parallelogram shaped side panels, wherein the panels in each pair of side panels are opposed to each other; and one or more drivers, wherein the alignment of the one or more drivers is substantially concentric about a first location on or in the first panel, wherein the housing is effective to optimize and emit a unidirectional response trajectory from the first location to a second location external to the housing.

2. The apparatus of claim 1, wherein each of the side panels comprises a first pair and a second pair of opposing and equal corner angles, the angles in the first pair are larger than the angles in the second pair, and the size of the angles in the first pair range from 91 to 131 degrees.

3. The apparatus of claim 2, wherein the size of the angles in the first pair range from 96 to 126 degrees.

4. The apparatus of claim 3, wherein the size of the angles in the first pair range from 101 to 121 degrees.

5. The apparatus of claim 4, wherein the size of the angles in the first pair range from 106 to 116 degrees.

6. The apparatus of claim 1, wherein the apparatus is a speaker.

7. The apparatus of claim 1, wherein the housing is effective to direct the response trajectory upwards, inwards or downwards.

8. The apparatus of claim 1, wherein the housing comprises two pairs of substantially parallelogram shaped side panels comprising a third panel opposed to a fourth panel and a fifth panel opposed to a sixth panel, respectively.

9. The apparatus of claim 1, wherein the one or more drivers is selected from the group consisting of a single driver, a coaxial driver, a dual concentric driver, a triaxial driver, a tri-concentric driver, a multi-concentric driver and a combination thereof.

10. The apparatus of claim 1, wherein the first front and the second back panels, and the side panels in each pair of parallelogram shaped side panels, are substantially parallel.

11. The apparatus of claim 1, wherein the one or more substantially concentric drivers comprises a high frequency speaker driver positioned within a low frequency speaker driver.

12. A loudspeaker system comprising at least one speaker according to claim 6.

13. The system of claim 12, further comprising at least one surface external to the housing, wherein one side panel in the at least two pairs of side panels is adjacent to the surface.

14. A speaker comprising a housing wherein the housing comprises:

a first front panel and a second back panel, wherein the first and the second panel are opposed to each other;

two pairs of substantially parallelogram shaped side panels comprising a third side panel opposed to a fourth side panel, and a fifth side panel opposed to a sixth side panel; and one or more drivers, wherein the alignment of the one or more drivers is substantially concentric about a first location on or in the first panel;

wherein the first and the second panels are substantially parallelogram shaped panels, and the housing is effective to optimize and emit a unidirectional response trajectory from the first location to a second location external to the housing.

15. The speaker of claim 14, wherein the one or more substantially concentric drivers comprises a high frequency speaker driver positioned within a low frequency speaker driver.

16. The speaker of claim 15, wherein the high and low frequency speaker drivers are concentric.

17. The speaker of claim 6, wherein the speaker is effective to optimize a phase response and a frequency response of the speaker, and the trajectory.

18. The loudspeaker system of claim 13, wherein the housing comprises two pairs of substantially parallelogram shaped side panels comprising a third panel opposed to a fourth panel and a fifth panel opposed to a sixth panel, and the third, fourth, fifth, or sixth panel is positioned adjacent to the surface.

19. The loudspeaker system of claim 12, further comprising at least one amplifier.

20. The system of claim 18, wherein the housing comprises:

a first panel and a second panel, wherein the first and the second panel are opposed to each other, substantially parallel, and substantially parallelogram shaped;

two pairs of substantially parallelogram shaped panels comprising a third panel opposed to a fourth panel and a fifth panel opposed to a sixth panel; and a high frequency speaker driver positioned within a low frequency speaker driver, wherein the high and low frequency drivers are substantially concentric and located on or in the first panel.

21. A method for optimizing the unidirectional response trajectory emitted by the apparatus of claim 1, the method comprising:

providing a surface effective to support the apparatus;

positioning one panel in the at least two pairs of substantially parallelogram shaped side panels adjacent to the surface, thereby supporting the housing on the surface; and directing the one or more drivers in the first panel to face substantially towards the second location, thereby optimizing the unidirectional response trajectory located between the first location and the second location.

22. A method for optimizing the unidirectional response trajectory emitted by the speaker of claim 14, the method comprising:

providing a surface effective to support the apparatus;

positioning one panel in the at least two pairs of substantially parallelogram shaped panels adjacent to the surface, thereby supporting the housing on the surface; and directing the one or more drivers in the first panel to face substantially towards the second location, thereby optimizing the unidirectional response trajectory located between the first location and the second location.

23. The method of claim 22, wherein the one panel is the third panel and the response trajectory is directed upwards, the one panel is the fourth panel and the response trajectory is directed downwards, the one panel is the fifth panel and the response trajectory is directed inward or the one panel is the sixth panel and the response trajectory is directed inward.

* * * * *